United States Patent [19]

Sur

[11] Patent Number: 4,465,185

[45] Date of Patent: Aug. 14, 1984

[54] CIGARETTE CASE WITH DETACHABLE FLAP

[76] Inventor: Jung S. Sur, 280-21, Shin jang 2-Dong, Song tan City Kyong gi-Do, Rep. of Korea

[21] Appl. No.: 405,032

[22] Filed: Aug. 4, 1982

[30] Foreign Application Priority Data

Jan. 6, 1982 [KR] Rep. of Korea ..... 82/52

[51] Int. Cl.[3] ..... B65D 85/10; B65D 75/00

[52] U.S. Cl. ..... 206/264; 206/616; 229/87 C

[58] Field of Search ..... 206/264, 271, 273, 607, 206/616; 229/87 C

[56] References Cited

U.S. PATENT DOCUMENTS

| | | | |
|---|---|---|---|
| 1,836,228 | 12/1931 | Dryer | 229/87 C |
| 2,330,150 | 9/1943 | Schweiker | 206/264 |
| 3,533,550 | 10/1970 | Benzon-Petersen | 206/264 |

*Primary Examiner*—William T. Dixson, Jr.
*Assistant Examiner*—Brenda J. Ehrhardt
*Attorney, Agent, or Firm*—Parkhurst & Oliff

[57] ABSTRACT

A cigarette package having a cutting tape attached to a perforated silver flap at a top end of the package for tearing the silver flap off easily and concurrently with the outer cellophane wrapping of the cigarette case, to provide smokers with a convenient way to open the cigarette package.

2 Claims, 4 Drawing Figures

CIGARETTE CASE WITH DETACHABLE FLAP

BACKGROUND OF THE INVENTION (1) Field of the Invention

The present invention relates to an equipment for tearing the silver leaf flap off of a cigarette case concurrently with the outer wrapper of cigarette case in order to make the flap easily to be detached from the cigarette case.

(2) Description of Prior Art

Formerly cigarettes used to be pulled out from a cigarette case after tearing the silver leaf flap off by hand. This was done after cutting the outer cellophane wrapper off along with the assumed cutting line of it by pulling the cutting tape, which proved to be quite troublesome in tearing the flap off.

Namely, even though the cap of outer cellophane may be cut off, it is unavoidable to press the revenue stamp on top of cigarette case by thumb and tear the silver leaf flap by fingernail.

In cutting the flap off from inner silver leaf wrapper concurrently with the cap of outer cellophane wrapper, the present device supplies smokers with convenience in opening the cigarette case.

SUMMARY OF THE INVENTION

To eliminate such troublesome operation of the prior art, the present invention makes it easy to cut the silver leaf flap off by extending the cutting tape and establishing it on the inside of the silver leaf flap along a perforated line. Consequently, smokers can open the flap of cigarette case handily.

Figure 1:
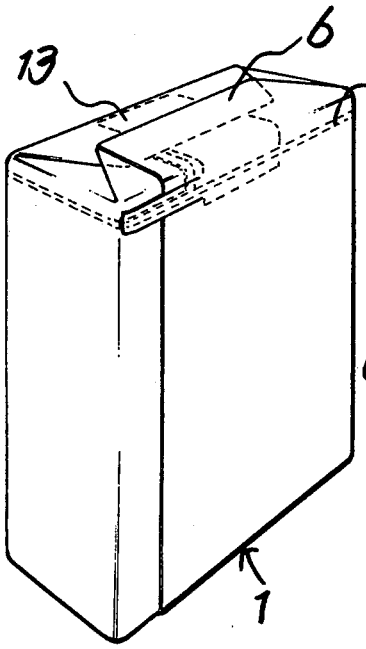
FIG. 1 is a perspective view of the present invention.
Figure 2:
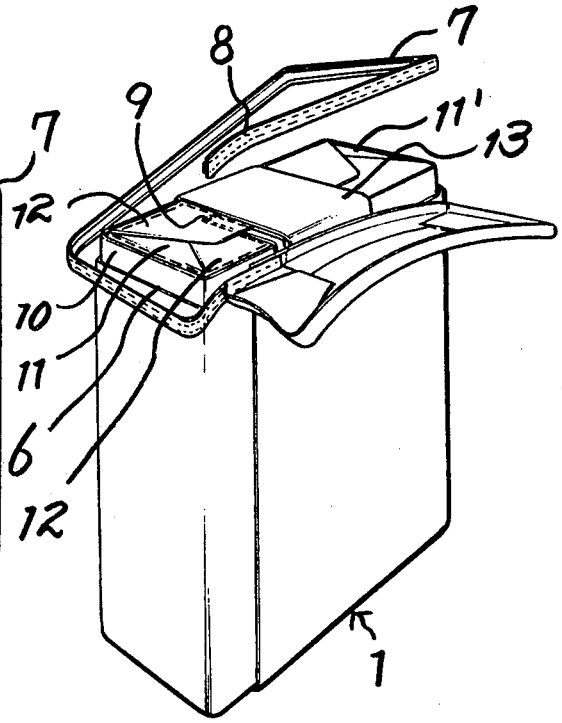
FIG. 2 is an illustration of the outer cellophane wrapper cut by cutting tape along the line to cut it off.
Figure 3:
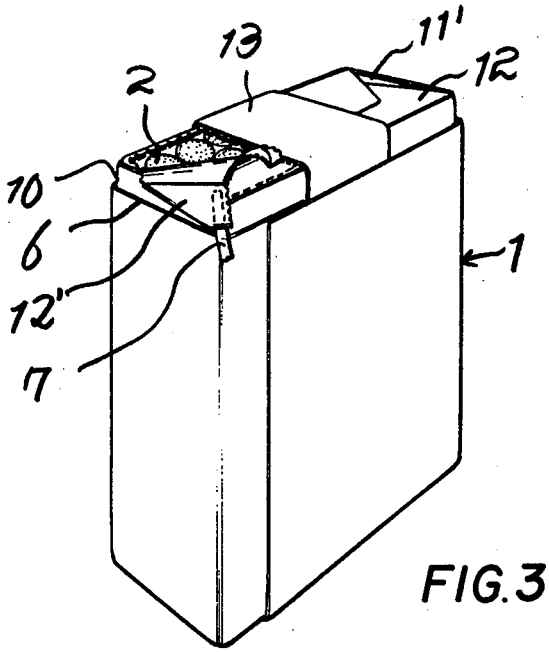
FIG. 3 is an illustration of inner silver leaf flap cut by a cutting tape using the present invention.

Legend 1. cigarette case
2. cigarettes
3. inner silver leaf wrapper 4,4'. perforated line 6. outer cellophane wrapper
7. cutting tape
9. flap cutting line 12'. the second horizontal flap

DETAILED DESCRIPTION OF THE INVENTION

The perforated line on the flap of the cigarette case is established along the fold line(5) of inner silver leaf wrapper(3) which packs the cigarettes(2) in the cigarette case(1). The ordinary cutting tape(7) is to be established from the catch, along with the assumed cutting line inside of the outer cellophane wrapper the other end of cutting tape(7) is extended to reach the cutting line of the flap.

Next, the cigarette case is to be wrapped in the outer cellophane wrapper with the lower side of it being sealed, the upper side being open.

Finally, the inner silver leaf wrapping the cigarettes(2) is to be folded.

As to the folding order, the two longitudinal flaps(11)(11') are to be folded for a start and after that the first horizontal flap(12) follows. The extended part of cutting tape is to be adhered to the overleaf of the second horizontal flap(12'), which is to be folded. After such operation, a revenue stamp(13) is put on the flap(12') and finally the cigarette case is to be packed up by the outer cellophane wrapper.

The present invention as illustrated above utilizes the prior art of opening outer cellophane wrapper, but extends another end of the cutting tape which is to be adhered to the overleaf of the second flap(12') to reach the cutting line of flap(9). Accordingly, the present invention is practiced with greater ease then techniques disclosed in the prior art.

Figure 4:
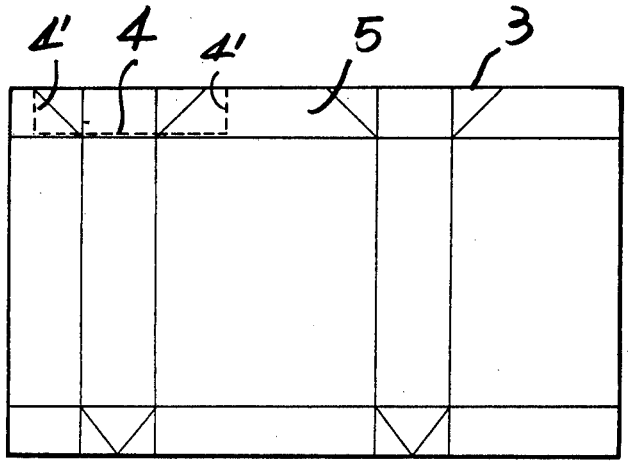
FIG. 4 is an exploded view illustrating the actual using state of the present invention.

Also, as the extended cutting tape(7) is extended and adhered to the overleaf of second horizontal flap(12') and the fold line(5) is perforated along the dotted line as shown in the FIG. 4, it is quite convenient to tear the flap(12') off concurrently with the outer cellophane wrapper by pulling the cutting tape.

Namely, though the vertical cut line(4') is to be cut along the cutting line of flap(9), the rest of the perforated line of the flap may be easily cut off by hand as the second horizontal flap(12') is being set up accordingly.

In view of the above description, the present invention is useful in cutting the flap(12)(12') off having the cutting tape(7) extended, without changing the ordinary package of cigarette case.

What is claimed is

1. A cigarette package, comprising:

a bottom;

sidewalls extending upwardly from said bottom;

a top comprising:

first and second opposed folded flaps;

a third flap folded over said first and second flaps to at least partially cover said first and second flaps; and a fourth flap folded over said third flap to at least partially cover said third flap, wherein each of said first, third and fourth flaps being perforated along an unbroken line extending along the fold of said first, third and fourth flaps;

an outer cellophane wrapping; and a cutting tape having a portion which extends under said cellophane wrapping and an end attached to the underside of said fourth flap, said fourth flap being further perforated above said end of said cutting tape.

2. A cigarette package as claimed in claim 1, further comprising a revenue stamp overlying a portion the package top, the second end of said tape extending parallel and immediately adjacent to said revenue stamp.

* * * * *